US005670993A

United States Patent [19]

Greene et al.

[11] Patent Number: 5,670,993

[45] Date of Patent: Sep. 23, 1997

[54] DISPLAY REFRESH SYSTEM HAVING REDUCED MEMORY BANDWIDTH

[75] Inventors: Spencer H. Greene, Palo Alto; Andrew D. Daniel, San Jose, both of Calif.

[73] Assignee: Alliance Semiconductor Corporation, San Jose, Calif.

[21] Appl. No.: 486,945

[22] Filed: Jun. 7, 1995

[51] Int. Cl.[6] ..... G09G 5/36

[52] U.S. Cl. ..... 345/189; 345/200

[58] Field of Search ..... 345/112, 185, 345/188, 189, 190, 192, 193, 196, 199, 200, 201

[56] References Cited

U.S. PATENT DOCUMENTS 4,233,601 11/1980 Hankins et al. ..... 345/112

4,799,053 1/1989 Van Aken et al. ..... 345/199

4,827,253 5/1989 Maltz ..... 345/199

*Primary Examiner*—Richard Hjerpe

*Assistant Examiner*—Regina Liang

*Attorney, Agent, or Firm*—Bradley T. Sako

[57] ABSTRACT

A display refresh system (10) is disclosed wherein a display image is stored in a screen memory (12) as a number of screen rows (26) having consecutive addressable units. A redundancy memory (38) includes a redundancy row (48) corresponding to each screen row (26). Each redundancy row (48) stores run length data that indicates the number of identical consecutive addressable units within a screen row (26). Addressable units are written with accompanying run lengths to a FIFO (54). A register repeater (56) repeats the addressable unit at the FIFO output (62) a number of times equal to the run length. The run length is used to advance the refresh address to the next group of identical consecutive addressable units within the screen row (26).

23 Claims, 4 Drawing Sheets

DISPLAY REFRESH SYSTEM HAVING REDUCED MEMORY BANDWIDTH

TECHNICAL FIELD

The present invention relates generally to display systems for computers, and more particularly to computer display refresh systems.

BACKGROUND OF THE INVENTION

Increasingly, computer operating systems and application programs are becoming more graphic intensive. Bit-mapped graphics and graphical user interfaces (GUIs) can require a large rate of data transfer to update the computer display, particularly at higher resolutions and color depths.

Computer display images are typically stored and manipulated in a display memory. The data comprising the screen image itself can be conceptualized as being stored in a portion of the display memory called the screen memory. The screen memory is continually updated by a controller (usually a graphics controller under the control of a microprocessor). In a graphics mode, the screen memory size and configuration is dependent upon the resolution and bit depth of the display image. Resolution is usually defined as the number of pixels displayed, i.e. 640×480, 800×600, 1024×768 and others. The "bit depth" is the number of bits provided for each pixel. A larger number of bits per pixel permits a greater selection of simultaneous screen colors.

The CRT display image is repeatedly updated through a display refresh operation. Display refresh involves transferring each pixel of the display image from the display memory to an output, once per frame. For displays having high resolutions and/or large bit depths, display refresh consumes a large amount of the total available display memory bandwidth, reducing the memory bandwidth available to the controller for other purposes (the "available update bandwidth") such as updating and manipulating the display image. This results in slower display performance for users.

It is known in the prior art to overcome bandwidth reduction due to display refresh by increasing overall memory bandwidth, employing larger bus widths or faster memory bus operating frequencies. Such solutions require an overall system upgrade however. Additional memory bandwidth has also been achieved by utilizing specialized memory devices such as multi-port random access memories (often called VRAMs in video applications). However, such approaches result in systems of increased COSTS.

It is therefore desirable to arrive at a solution that reduces required display refresh bandwidth, thereby increasing available update bandwidth without incurring substantial additional costs or requiring a significant change in overall system design. By reducing required refresh bandwidth the performance of interactive graphics displays can be improved.

SUMMARY OF THE INVENTION

It is an object of the present invention to provide a graphics display system with increased available update bandwidth that does not require a substantial amount of additional memory.

It is another object of the present invention to provide a graphics display system that reduces the amount of display memory bandwidth required for display refresh.

According to the present invention the display image of a computer system is stored as a plurality of screen lines, each screen line being composed of a number of consecutive bit groups (referred to herein as addressable units). The system further includes a redundancy memory having a redundancy row line corresponding to each screen line. Each redundancy row line stores redundancy data that includes a "repeat bit" for every addressable unit in a screen line. The value of the repeat bit indicates whether or not the addressable unit is identical to the previous addressable unit. The repeat bit takes one of two states; SKIP (meaning identical to the previous addressable unit) or NONSKIP (meaning different than the previous addressable unit).

During a refresh operation each screen line is read from screen memory in consecutive addressable units. If the screen line has not been written to by the controller since the redundancy data were last computed, the redundancy data are used by a repeating circuit to repeat those addressable units that match their immediately preceding identical addressable unit, instead of fetching said addressable unit from the display memory. A NONSKIP bit indicates a new data word must be fetched from the display memory.

If the screen line has been written to since the last redundancy data were computed, the redundancy data are possibly inaccurate and therefore are not used. Rather, each addressable unit in the screen line is read and displayed. During this operation the redundancy data for that screen line are recomputed and written to the redundancy memory.

An advantage of the present invention is that it takes advantage of the large areas of constant color or regular patterns common to many GUIs.

Other objects and advantages of the invention will become apparent in light of the following description thereof.

DETAILED DESCRIPTION OF THE EMBODIMENTS

Figure 1:
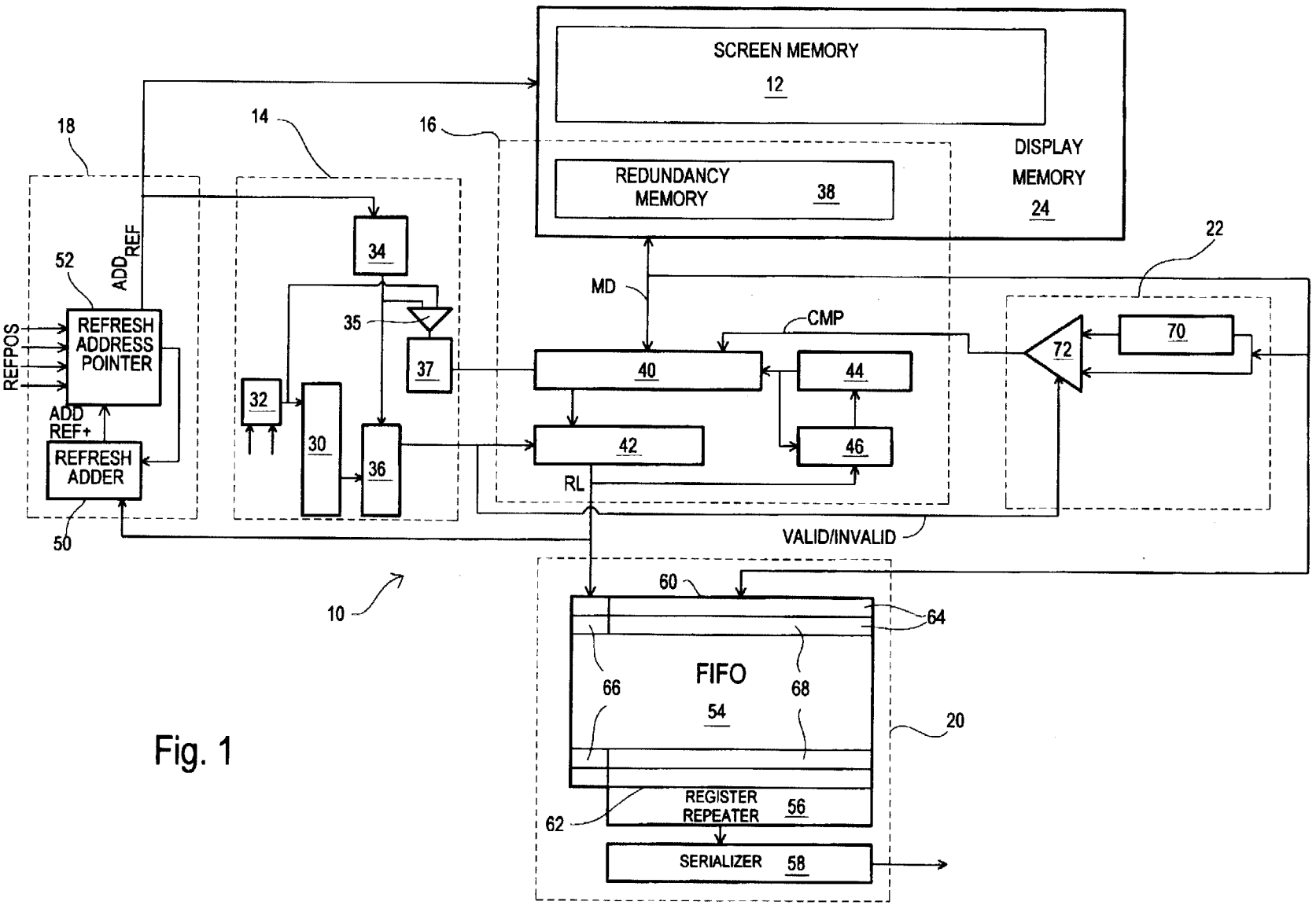
FIG. 1 is a block schematic diagram illustrating a preferred embodiment of the present invention.

FIG. 1 shows a block schematic diagram of a display refresh system 10. The display refresh system 10 includes, generally, a screen memory 12, a row valid detect section 14, a redundancy data section 16, a refresh address modify section 18, a data output repeat section 20, and a redundancy detect section 22. In the preferred embodiment, the screen memory 12 is a portion of a total display memory 24.

Figure 2:
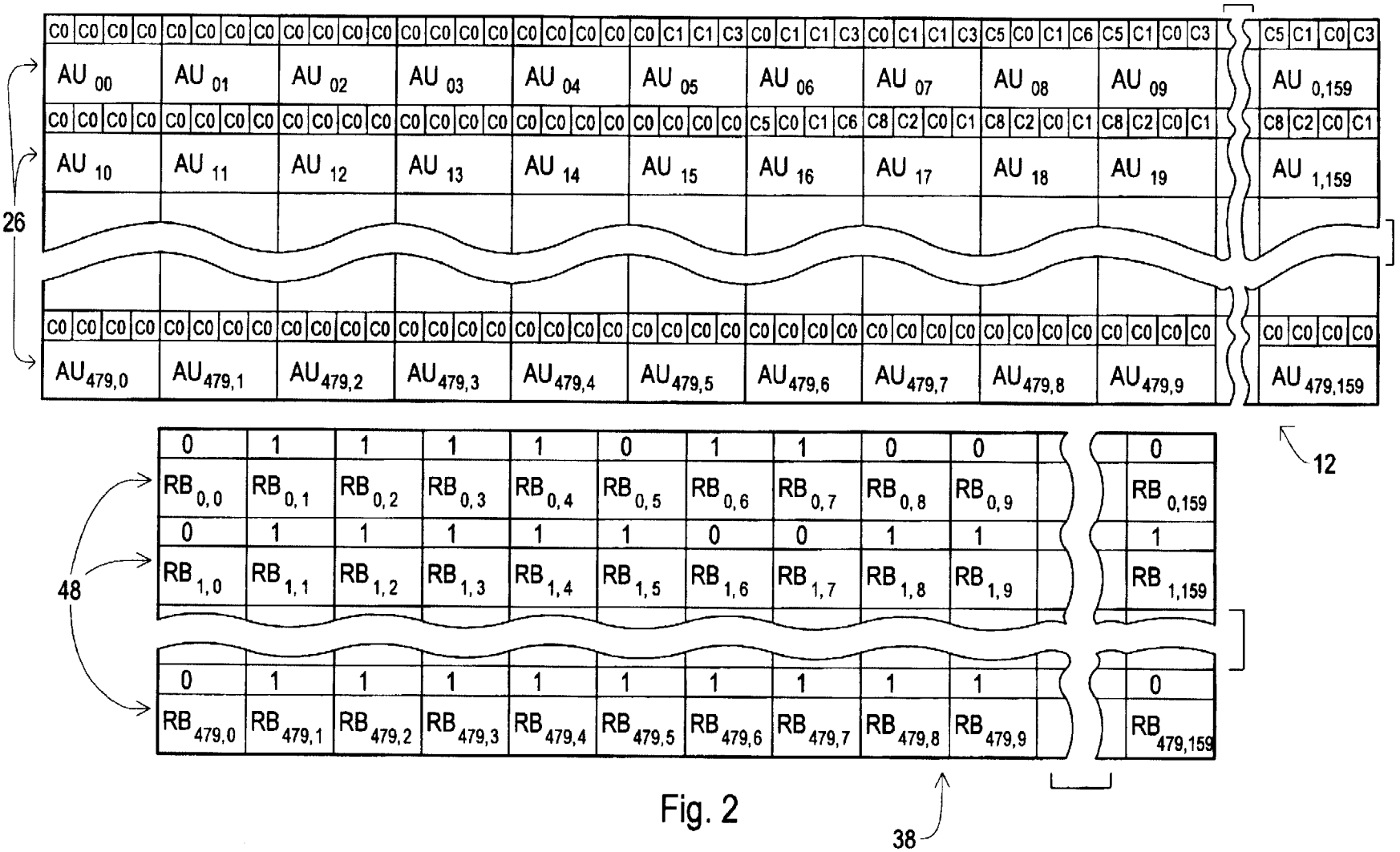
FIG. 2 is a block schematic diagram illustrating the screen memory and the redundancy data memory of the preferred embodiment of the present invention.

A portion of the screen memory 12 of the preferred embodiment is set forth in FIG. 2. The screen memory 12 includes a number of screen rows 26, with each screen row 26 representing a line of a display image. In the embodiment shown in the figure, the display image represented has a resolution of 640×480 with a pixel depth of eight (8) bits. It is understood that the embodiment illustrated could be configured for many different display modes and the resolution of 640×480 is intended to be illustrative only. At 640×480 resolution each screen row is composed of 5,120 bits. The screen memory 12 is shown divided into eight bit groups representing pixel color, referred to herein as pixel color data. The various pixels are shown as Cn, where different values of n represent different eight bit combinations signifying color. In FIG. 2, the pixel data for the first 40 pixels and the last four pixels of screen rows 0, 1 and 479 are shown.

As is well known in the art, the data of the screen memory 12 are addressable by a row and column address. In the preferred embodiment, the screen memory 12 is addressable in 32-bit groups, or the equivalent data of four consecutive pixels. For the purposes of this description the 32-bit groups will be referred to hereinafter as "addressable units" (AUs). Thus, each screen row 26 of the example set forth in FIG. 2 has 160 AUs. The AUs are identified by their screen row number and column number. Further, a fixed, integral number of AUs are defined herein as "redundancy units" (RUs). In the preferred embodiment one AU is equal to one RU.

Figure 3:
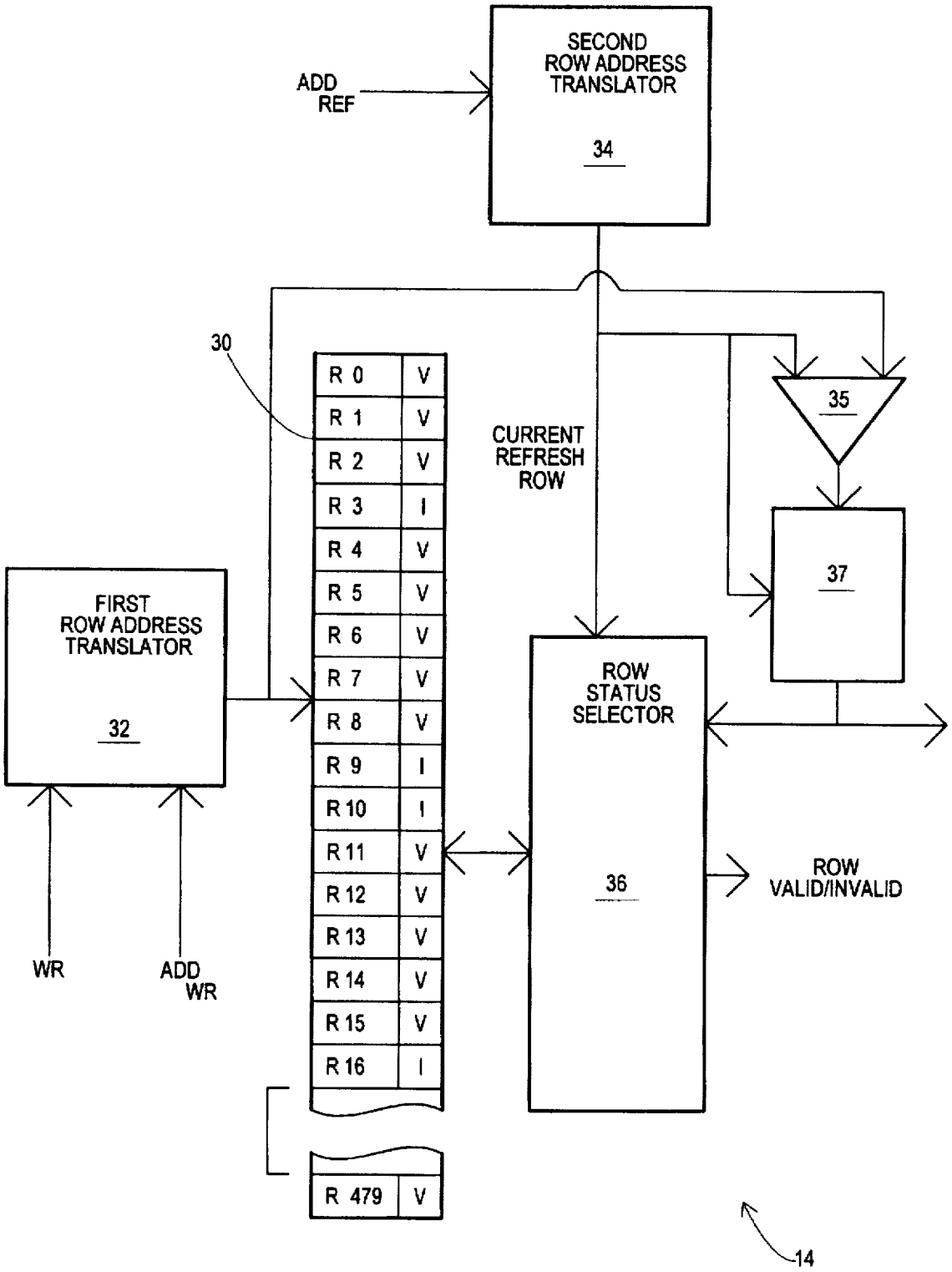
FIG. 3 is a block schematic diagram illustrating the row valid detect section of the preferred embodiment of the present invention.

Referring now to FIG. 3 the row valid detect section 14 is set forth in more detail. As shown in the figure, the row valid detect section 14 includes a row valid buffer 30, a first row address translator 32, a second row address translator 34, an address comparator 35, a row status selector 36 and a strike detect register 37. The row valid buffer 30 includes a one bit storage location for storing a row status bit corresponding to each screen row 26 in the screen memory 12. Each bit can take either of two values; "VALID" or "INVALID" (shown as "T" and "V" respectively, in the figure). For the screen memory 12 example of FIG. 2, the row valid buffer 30 includes 480 bit locations.

The first row address translator 32 receives a write command WR, and a write address $ADD_{WR}$ as inputs. The write command and write address are generated by a controller during a write operation to the display memory 24. The first row address translator 32 translates the write address and provides it to the row valid buffer 30 and the address comparator 35. If a the write address corresponds to a screen row 26, the row status bit in the row valid buffer 30 corresponding to the screen row 26 written to is set INVALID. In this manner, a record is maintained of any write operations to any of the screen rows 26. Upon start-up, all of the row status bits of the row valid buffer 30 are set INVALID. In the example shown in FIG. 3, status bits are identified as "RF" where Y is the screen row 26 number. Therefore, in the example set forth, screen rows 0–2 and 4–8 currently have a valid status, while screen row 3 is invalid.

The second row address translator 34 receives a refresh address as an input, shown as $ADD_{REF}$. Like the first row address translator 32, second row address translator 34 translates the refresh address and if it corresponds to a screen row 26, the screen row number information is provided as an input to the row status selector 36. According to the input from the second row address translator 34, the row status selector 36 latches the value of the row status bit (i.e., VALID or INVALID) that corresponds to the screen row 26 selected by the refresh address. This latched value is provided as an output from the row status selector 36. Following the latching operation, the row status bit within the row valid buffer is "reset" to VALID. For example in FIG. 3, if the refresh address is for screen row 2 (R2), this is detected by the second address translator 34 and the screen row number is provided to the row status selector 36. The row status selector 36, in turn, latches, and provides as an output, the VALID bit value for R2. Conversely, on the next refreshed row (row three) the INVALID row status bit is latched and provided as an output at the row status selector 36, and the row status bit is reset to VALID.

The address comparator 35 and a strike detect register 37 operate to detect when a screen row 26 that is currently being refreshed is written to by the controller. Such an event is referred to herein as a "lightning strike." The strike detect register 37 is a one bit register that is held at one of two states; STRIKE or NOSTRIKE. The strike detect register 37 receives the current refresh address as an input, and upon a change in row address (indicating a new row is to be refreshed) is set to NOSTRIKE. A second input to the strike detect register 37 is provided by the address comparator 35. The current refresh row and write address are provided as inputs to the address comparator 37. In the event these addresses are the same, a lightning strike has occurred, and the address comparator 35 provides an output that changes the strike detect register 37 to the STRIKE status. The status of the strike detect register 37 is provided as an output to the redundancy data section 16. A lightning strike also affects the row status bit initially latched by the row valid buffer 30. As shown in FIG. 3 the row status selector 36 receives the strike detect register 37 as an input. If the row status bit initially latched is VALID, a lightning strike will change the latched value to INVALID.

Figure 4:
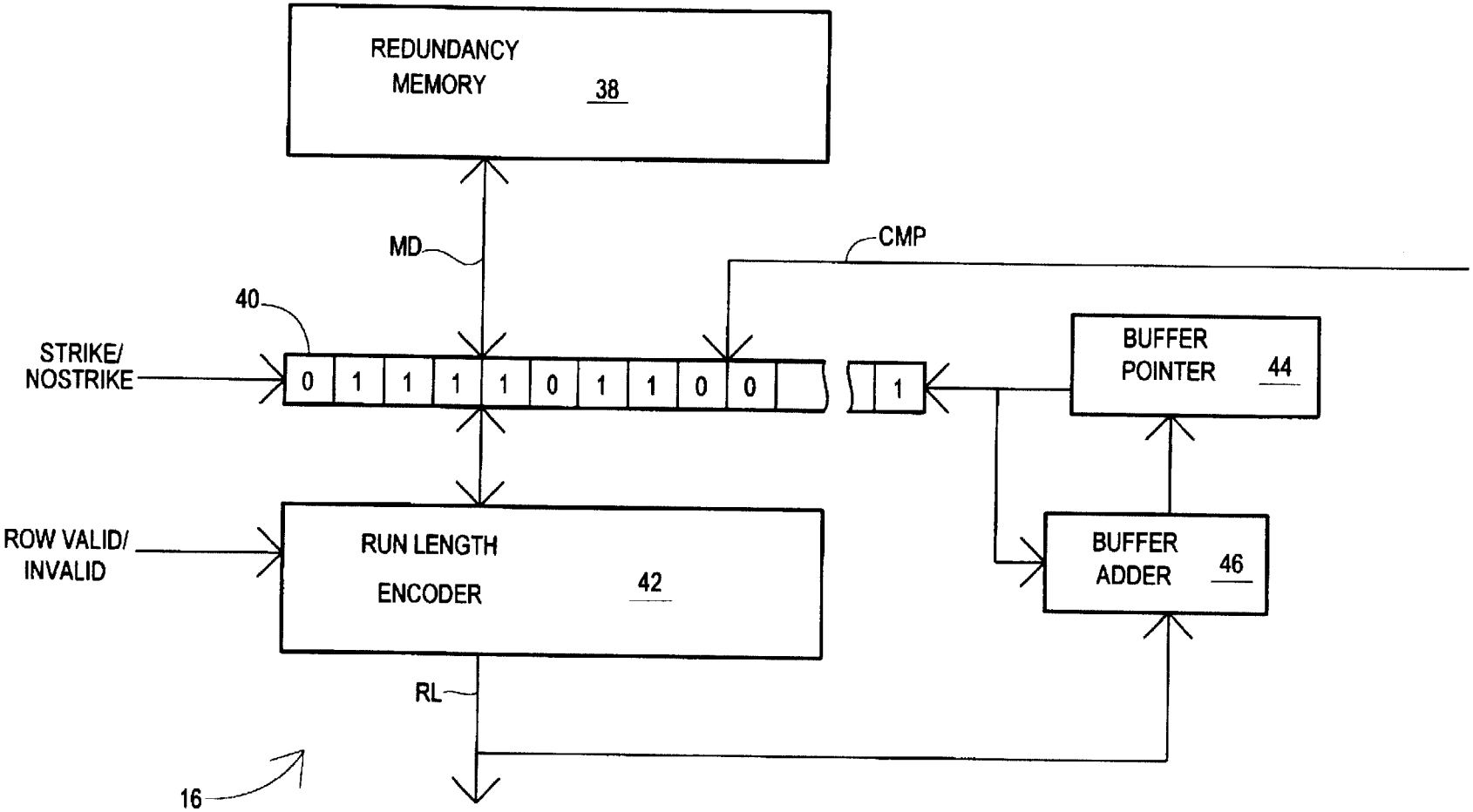
FIG. 4 is a block schematic diagram illustrating the redundancy data section of the preferred embodiment of the present invention.

Referring now to FIG. 4, the redundancy data section 16 is set forth in more detail, and is shown to include a redundancy memory 38, a horizontal redundancy buffer (hereinafter "HR buffer") 40, a run length encoder 42, a buffer pointer 44, and a buffer adder 46. In the preferred embodiment, as shown in FIG. 1, the redundancy memory 38 is part of the total display memory 24.

Referring once again to FIG. 2, a more detailed depiction of the redundancy memory 38 is shown in conjunction with its corresponding screen memory 12. The redundancy data memory 38 includes a redundancy data row 48 corresponding to each screen row 26 in the screen memory 12. In a similar fashion each redundancy data row 48 includes a bit location corresponding to each RU in the screen row 26. In the example of FIG. 2, the redundancy data memory 38 has 480 redundancy data rows 48, with each redundancy data row 48 having 160 bits. It is understood that the redundancy data memory 38 is configurable, with a larger screen memory 12 having a larger corresponding redundancy data memory 38.

In FIG. 2, the bit locations within the redundancy data memory 38 are identified as "RB" and each include a row and column number that corresponds to the RU that the bit represents. Each RB is either a SKIP bit ("1") indicating that the RU it represents is identical to the previous RU in that screen row 26, or a NONSKIP bit ("0") indicating that the RU it represents is different than the previous RU within the screen row 26.

Referring once again to FIG. 2, the relationship between the screen rows 26 and their corresponding redundancy data rows 48 is shown in detail. In the preferred embodiment, the first bit of every redundancy data row 48 is always a NONSKIP bit (0) as it represents the first RU of a screen row 26 and there is no previous RU to compare it with. Thus, bits $RB_{00}$, $RB_{10}$, and $RB_{479,0}$ of FIG. 2, are all NONSKIP bits (0s). In the example of FIG. 2, $AU_{01}$, $AU_{02}$, $AU_{03}$, and $AU_{04}$ all have the same pattern as $AU_{00}$ (C0 C0 C0 C0). Accordingly, $RB_{01}$, $RB_{02}$, $RB_{03}$ and $RB_{04}$ are each SKIP bits (1s). Because $AU_{05}$ (C0 C1 C1 C3) is different than $AU_{04}$, bit $RB_{05}$ is a NONSKIP bit (0) indicating no repetition in RU value. In this fashion each redundancy data row 48 contains redundancy data for its corresponding screen row 26. The manner in which the redundancy data are gathered for each redundancy data row 48 will be discussed in more detail herein.

Referring once again to FIG. 4 it is shown that the HR buffer 40 is coupled to the display memory 24 by data bus MD. By way of the MD data bus, the HR buffer 40 receives data from the redundancy data memory 38. In the preferred embodiment the HR buffer 40 receives the data of one redundancy data row 48. Thus, for the example of FIGS. 2 and 4, the HR buffer 40 holds 160 bits. In FIG. 4, the data of the first redundancy data row (row 0) is shown loaded in the HR buffer 40. It is understood that while the HR buffer 40 in the example in FIG. 4 stores 160 bits, the total capacity of the HR buffer 40 is sufficient to handle larger redundancy data row 48 sizes that correspond to higher display image resolutions.

As shown in FIG. 4, the HR buffer 40 is coupled to the run length encoder 42. The run length encoder 42 computes from the data in the HR buffer 40 a run length value that is the number of times an RU value is repeated consecutively in a screen row 26. In the preferred embodiment, the run length encoder 42 reads data from the HR buffer 40 according to a buffer position provided by the buffer pointer 44. A run length is then computed as the total of a first NONSKIP bit (0) and any SKIP bits (1s) that follow. For example, referring now to FIG. 4, assuming the buffer pointer 44 is pointing to the first position in the HR buffer 40, the run length encoder 42 will read the first run of bits, 01111, stopping at the next encountered NONSKIP bit (0, the sixth bit in the HR buffer 40). As mentioned previously, the first run of bits is encoded into "run length" corresponding to the NONSKIP bit (always a single "0") and the total number of SKIP bits that follow (in this case four). Thus, 01111 is encoded to 5. The run length, shown as "RL," is then provided as an output from the run length encoder 42. The run length encoder 42 is then ready to compute the next run length. The buffer pointer 44 is advanced to the next NONSKIP bit by feeding the run length to the buffer adder 46 which advances the buffer pointer 44 a number of bit locations equal to the run length. In this manner successive run lengths are computed and output from the run length encoder 42. Once all the run lengths have been read from the HR buffer 40 the data of the next redundancy data row 48 are loaded.

In the preferred embodiment, the run length encoder 42 can encode a maximum run length of 16 bits (the data representing 16 RUs), with the run length output being four bits wide. In the event the run length exceeds 16 bits in length, the 17th bit will be treated as if it is a NONSKIP bit.

Referring once again to FIG. 4, it is shown that the run length encoder 42 receives the status of the row status bit latched by the row status selector 36. It is recalled that the status of this bit indicates whether or not the currently refreshed screen row 28 has been written to (INVALID state) or not (VALID state) since the last time the redundancy data for the screen row were computed. If the status is VALID the run length encoder 42 and HR buffer 40 operate in the manner previously described. If the status in INVALID, however, the redundancy data section 22 generates new redundancy data from the current, screen row 26 and inputs it into the HR buffer 40. In addition, for an INVALID status the data within the HR buffer 40 are ignored by the run length encoder 42 and the run length encoder 42 defaults to outputting run lengths of one.

New redundancy data are generated and input into the HR buffer 40 by the INVALID status enabling a comparator input (CMP) to the HR buffer 40. When enabled, CMP writes redundancy data into the HR buffer 40. In the preferred embodiment, this is performed one bit at a time. At the beginning of the refresh of a given screen row 26, the buffer pointer 44 points to the staff of the HR buffer 40. When the CMP is enabled, as a bit of data is received from the CMP it is written into the first bit location of the HR buffer 40. By operation of the buffer adder 46, the buffer pointer 44 is advanced one location according to the run length encoder output (always one when the current row is INVALID). The HR buffer 40 is then ready to receive the next bit from the CMP. The generation of the CMP signal will described at a later point herein.

In addition to the MD and CMP inputs, the HR buffer 40 also receives the status of the strike detect register 37 (either STRIKE or NOSTRIKE). Once the HR buffer 40 contains the redundancy data for an entire screen row 26 the newly acquired redundancy data are either written to the redundancy data memory 38 or ignored depending upon the status of the strike detect register 37. A STRIKE status indicates that the screen row 28 from which the redundancy data have just been acquired has been written to during refresh. As a result, there is no guarantee the data within the HR buffer 40 are valid. Accordingly, the data within the HR buffer 40 are ignored and refresh operation continues with the next screen row 26. A NOSTRIKE status indicates that the screen row 28 has not been written to and the redundancy data within the HR buffer 40 represent the data within the refreshed screen row 26. Accordingly, the data are written to the redundancy data row 48 corresponding to the refreshed screen row 26.

Referring once again to FIG. 1, the refresh address modify section 18 of the preferred embodiment will now be described in detail. Refresh addresses are provided by the refresh modify section 18 to sequentially indicate which RUs are to be read from the screen memory 12. The refresh address modify section 18 of the preferred embodiment is shown to include a refresh adder 50 and a refresh address pointer 52. The refresh address pointer 52 provides a refresh address ($ADD_{REF}$) in response to refresh positioning information (REFPOS in FIG. 1) and an adjusted address ($ADD_{REF+}$). The refresh positioning information indicates the position of the screen memory 12 within the display memory 24, and includes a left upper corner address, screen width, and any row pitch information for the screen. The positioning information is well known in the art and so will not be discussed in any further detail herein. The refresh adder 50 receives a previous refresh address and a run length as inputs. The refresh adder 50 increases the refresh address according to the run length value to arrive at the adjusted refresh address.

The operation of the refresh address modify section 18 of the present invention is best understood in comparison to conventional refresh addressing schemes. Conventional refresh addressing schemes result in AUs for each screen row being addressed from the left column of each screen row to the right column, in a consecutive fashion. In contrast, in the present invention the refresh address skips redundant data by operation of the refresh adder 50. In the preferred embodiment, the refresh adder 50 increases the column address in the given screen row 26 by a number of columns equal to the run length, rather than simply incrementing the column address as is done in a conventional scheme. Assuming there are at least some RU repetitions in a given screen line, the number of times the screen memory 12 must be addressed during a refresh operation is reduced. In the case where large amounts of the display image are of uniform color or pattern, this reduction is significant.

The reduction in the number of display memory accesses during screen refresh is further understood by a description of the data output repeat section 20 of the preferred embodiment. Referring now to FIG. 1, the data output repeat section 20 is shown to include an output first-in-first-out buffer (FIFO) 54, a register repeater 56, and a serializer 58. The FIFO 54 includes a FIFO input 60, a FIFO output 62, and a number of FIFO registers 64. As shown in FIG. 1, each FIFO register 64 has two fields, a run length field 66 and a data field 68. The run length field 66 receives a run length from the redundancy data section 16, and the data field 68 receives an RU from the data bus, MD. In the preferred embodiment, the run length field 66 is 4 bits wide to accommodate the 4 bit encoded run length, and the data field 68 is 32 bits wide to accommodate one RU from the screen memory 12. During operation, the data within the FIFO registers 64 (the run length and RU) are clocked through the FIFO 54 together. The register repeater 56, situated at the FIFO output 62, extracts the FIFO register data one time and outputs the value of the RU in the last FIFO register 64 to the serializer 58 a number of times equal to the run length. When the register repeater 56 is outputting a given RU to the serializer 58 for the second or subsequent consecutive time, no further data are extracted from the FIFO 54. The serializer 58, well known in the prior art, divides each RU it receives into pixel depth (PIXDEP) bits and provides them as a serial output. Thus, where prior art designs would read consecutive, identical RUs from screen memory and write each to a FIFO, the present invention reads a single RU (and one bit redundancy codes for each RU) and write the RU to the FIFO 54 accompanied by a run length. As an example, for the screen memory illustrated in FIG. 2, a conventional refresh operation would write the data in five write operations, filling five conventional FIFO registers with the same data (C0 C0 C0 C0). In contrast, the preferred embodiment would make one write of (C0 C0 C0 C0) with an accompanying run length of 5, reducing the number of reads from the screen memory from five to one.

Referring once again to FIG. 1, the redundancy detect section 22 is shown to include a hold register 70 and a comparator 72. The comparator is controlled by the status of the row status bit latched by the row status selector 36. If the status is VALID, the comparator 72 is disabled, and correspondingly, the comparator signal CMP is disabled. If the status is INVALID the comparator 72 is enabled providing the CMP signal to the HR buffer 40. During the refresh operation for any given "invalid" row the redundancy detect section 22 receives the RU read from the screen memory 12 and compares it with the immediately previous RU to determine if the two are identical. The result of the comparison operation is used to generate the redundancy data provided by the CMP. In the preferred embodiment the comparator 72 receives one 32-bit input from the data bus MD, and another from the 32-bit hold register 70. The hold register 70 stores an RU read from the screen memory 12 after the comparison is complete. When a subsequent RU is output, it is compared by the comparator 72 with the data stored within the hold register 70. The comparator 72 generates a SKIP bit (1) output if the RUs are the same, or a NONSKIP bit output (0) if they are different. In this manner the CMP signal is generated.

In the preferred embodiment, all elements of the display refresh system 10, except for the display memory 24, are intended to be incorporated as part of a monolithic semiconductor graphics controller device. The display memory 24 is provided by an external bank of random access memory (RAM).

One skilled in the art would recognize that the present invention may accommodate higher resolutions that require more redundancy data in a single screen row than the HR buffer size and/or available redundancy row lengths can accommodate. In such a case, larger RU sizes could be used, with a correspondingly larger hold register and comparator size, or a smaller comparator executing multiple comparator operations. In another variation all AUs outside the range of the redundancy memory could be written to the FIFO in a conventional fashion (one AU at a time, run lengths defaulted to one). Along the same lines it is recognized that the particular arrangement of the preferred embodiment should not be read as limiting. As just one example, there could be two HR buffers, one for receiving redundancy data for a row refresh operation, the other for compiling redundancy data during row refresh, resulting in two entirely different read and write paths to and from the display memory.

Accordingly, as will be apparent to one skilled in the art, the invention has been described in connection with its preferred embodiments, s and may be changed, and other embodiments derived, without departing from the spirit and scope of the invention as set forth in the claims which follow.

What we claim is:

1. An improved computer graphics display refresh system, comprising:

a screen memory for storing and manipulating a display image as a plurality of addressable units, the addressable units of the display image being arranged in a plurality of display rows;

redundancy data means for providing a plurality of successive run lengths for each display row, the run lengths representing consecutive repetitions of identical addressable units in the display row;

refresh address means for generating a refresh address, said refresh address means including an address advancer for advancing the refresh address in response to the run lengths of said redundancy data means;

repeating FIFO means for receiving a plurality of consecutive addressable unit/run length pairs, said repeating FIFO means repeatedly outputting the value of the addressable unit in response to its accompanying run length; and a controller for writing the addressable unit at the refresh address and an accompanying run length to said repeating FIFO means.

2. The refresh system of claim 1 further including:

a run length detect means for recording the run lengths of each display row as the display row is refreshed.

3. The refresh system of claim 2 further including:

row status means for providing a row status for each display row, the row status of each display row being reset to VALID when refresh of the display row commences, the row status switching to INVALID if the display row is written to, a VALID status prior to reset indicating a redundancy data first mode of operation, an INVALID status prior to reset indicating a redundancy data second mode of operation;

said redundancy data means storing run lengths recorded by said run length detect means during the second mode and outputting run lengths during the first mode;

the address advancer of said refresh address means being disabled in the second mode; and the repeating function of said repeating FIFO means being disabled in the second mode.

4. The system of claim 3 wherein:

said row status means further includes a strike register that is set to a NOSTRIKE state when refresh of the display row commences, the strike register being changed to a STRIKE state if the display row being refreshed is written to; and said redundancy data means storing run lengths of a refreshed display row after the display row is refreshed only in the second mode and if the strike register is in the NOSTRIKE state.

5. The system of claim 3 wherein:

said row status means further includes a plurality of row registers, at least one row register corresponding to each display row, each row register storing the row status of its respective display row.

6. The system of claim 5 wherein:

said row status means further includes row decoder means for selecting the row status register according to the refresh address.

7. The system of claim 3 wherein:

said redundancy data means further includes a redundancy data memory having a redundancy data row corresponding to each display row, each redundancy data row including a bit location for each addressable unit within its corresponding display row, each bit location storing a SKIP value or a NONSKIP value, the SKIP value indicating the addressable unit corresponding to the bit location is identical to the previous addressable unit in the display row, the NONSKIP value indicating the addressable unit corresponding to the bit location is different than the previous addressable unit, each run length being the total of an initial NONSKIP bit and the number of consecutive SKIP bits following the initial NONSKIP bit.

8. The system of claim 7 wherein:

the redundancy data memory of said redundancy data means and said screen memory are portions of a display memory.

9. The system of claim 7 wherein:

said redundancy data means further includes a row redundancy buffer for storing a redundancy data row.

10. The system of claim 9 wherein:

said redundancy data means further includes a run length encoder coupled to the row redundancy buffer for computing run lengths from the SKIP bits and NONSKIP bits.

11. The system of claim 10 wherein:

the run length encoder generates run lengths of one for the entire display row in the second mode.

12. The system of claim 10 wherein:

said redundancy data means further includes a buffer position indicator, for advancing a buffer position in response to the run lengths of the run length encoder.

13. The system of claim 2 wherein:

said run length detect means includes a comparator for comparing successive addressable units written from screen memory to said repeating FIFO means.

14. The system of claim 13 wherein:

the comparator has at least two inputs; and said run length detect means further includes a compare register coupled to one input of the comparator for storing a previous addressable unit, the addressable unit provided to said repeating FIFO means being further provided as a second input to the comparator.

15. The system of claim 13 wherein:

the comparator provides a compare output bit for each compare operation to said redundancy data means, the compare output bit being a SKIP bit if successive addressable units are identical, the compare output bit being a NONSKIP bit if successive addressable units are different.

16. The system of claim 1 wherein:

the refresh address generated by said refresh address means includes a row address and a column address, and said refresh address means includes an address pointer and an address adder, the address pointer providing the refresh address, the address adder receiving a run length corresponding to the current display row and advancing the column address of the refresh address according to the run length.

17. The system of claim 1 further including:

serializing means operatively coupled to the output of the repeating FIFO means for serializing the value of each addressable unit output from the repeating FIFO means.

18. In a graphics system wherein a display image is stored in a display memory as screen data in a plurality of screen rows, each screen row having a plurality of bits addressable as addressable units, the screen data being modified by a controller and the display image being periodically refreshed by writing the screen data to an output, a method of reducing the memory bandwidth consumed by the refresh operation, comprising the steps of:

providing a redundancy data memory having a redundancy data row corresponding to each screen row;

determining if a screen row has been modified since a previous recording of redundancy data;

if the screen row has been modified, recording the redundancy data of consecutive addressable units to the redundancy data memory; and if the screen row has not been modified, beginning with the first addressable unit, generating a run length from the redundancy data, outputting the addressable unit a number of times corresponding to the run length, skipping subsequent addressable units according to the run length, selecting a next addressable unit and generating a next run length, and repeat this step until the end of the redundancy data row and the screen row is reached.

19. The method of claim 18 wherein:

the step of determining if a screen row has been modified includes the substeps of providing a row valid buffer having a bit storage location corresponding to every screen row, examining the addresses of data written to the screen data to determine which screen row has been modified, writing a row INVALID bit into the bit location corresponding to the modified screen row, and writing a row VALID bit prior to recording the redundancy data of a screen row into the bit location corresponding to the screen row.

20. The method of claim 18 wherein:

the step of recording the redundancy data of consecutive addressable units includes the substeps of comparing an addressable unit with a previous addressable unit to generate a compare bit, the compare bit being a SKIP bit if the compared addressable units are the same and a NONSKIP bit if the compared addressable units are different, and writing the compare bits to the redundancy data row, each redundancy data row having an initial NONSKIP bit, each run length having a size equal to a NONSKIP bit in addition to any subsequent, consecutive SKIP bits.

21. The method of claim 18 wherein:

each addressable unit has a column and a row address;

the step of skipping subsequent addressable units according to the run length includes the substeps of providing a refresh address pointer for indicating which addressable unit is to be output during a refresh operation, and advancing the column address according to the current run length.

22. The method of claim 18 wherein:

the step of outputting an addressable unit a number of times corresponding to the run length includes the substeps of providing a FIFO with a first field and a second field, the addressable unit being loaded into the first field, the run length being loaded into the second field, and providing a repeating circuit at the output of the FIFO that repeats the addressable unit according to the corresponding run length, and advancing the FIFO once the repeating operation of the repeating circuit is complete.

23. The method of claim 18 wherein:

the step of determining if a screen row has been modified includes the substeps of providing a row valid buffer having a bit storage location corresponding to an integral number of screen rows, examining the addresses of data written to the screen data to determine which of the integral number of screen rows has been modified, writing a row INVALID bit into the bit location corresponding to the modified integral number of screen rows, and writing a row VALID bit prior to recording the redundancy data of the integral number of screen rows into the bit location corresponding to the integral number of screen rows.

* * * * *